United States Patent [19]

Bratt

[11] 3,955,816

[45] May 11, 1976

[54] WARM-UP BAT

[76] Inventor: Leonard R. Bratt, 84 Woodlawn St., Lynn, Mass. 01904

[22] Filed: Mar. 11, 1974

[21] Appl. No.: 449,737

[52] U.S. Cl. ..... 273/26 B; 272/72

[51] Int. Cl.[2] ..... A63B 59/00

[58] Field of Search ..... 273/26 B, 67 R, 67 B, 273/67 D, 72 R, 72 A, 75, 81 A, 81 B, 84; 272/84, 72 R

[56] References Cited

UNITED STATES PATENTS

| | | | |
|---|---|---|---|
| 875,273 | 12/1907 | Kimble | 273/26 B |
| 897,201 | 8/1908 | Gannon | 273/84 |
| 2,379,006 | 6/1945 | Johnson | 273/72 R |
| 2,930,639 | 3/1960 | Wood | 273/72 |
| 3,116,926 | 1/1964 | Owen et al. | 273/26 B |
| 3,231,281 | 1/1966 | Wallo | 273/84 |
| 3,246,894 | 4/1966 | Salisbury | 273/72 R |
| 3,479,030 | 11/1969 | Merola | 273/72 R |
| 3,578,801 | 5/1971 | Piazza | 273/26 B |
| 3,638,943 | 2/1972 | Sanauwaert | 272/73 J |
| 3,674,267 | 7/1972 | Hollis | 273/75 |
| 3,801,098 | 4/1974 | Gildenmeiser | 273/72 A |

*Primary Examiner*—Richard J. Apley
*Assistant Examiner*—T. Brown
*Attorney, Agent, or Firm*—Thomas C. Stover, Jr.

[57] ABSTRACT

A warm-up bat with a closeable hollow chamber with granular weight material therein is provided to result in a practice ball bat with a distributed weight or bat-like feel. The bat is made in two sections. A handle section and a rigid tubular section. The tubular section is larger in diameter than the handle section and has a chamber therein. The handle section has one of its ends telescoped into one end of the tubular section and fastened therein; the other end of the handle section being engagable by a batters hands. The chamber of the tubular section is filled with a flowable weighting material such as sand and the other end of the tubular section is closed to retain the weighting material in the chamber.

7 Claims, 2 Drawing Figures

WARM-UP BAT

FIELD OF THE INVENTION

This invention relates to a practice bat, particularly a heavyweight practice or warm-up bat.

THE PRIOR ART

In the games of baseball, softball and the like, warm-up bats are often swung by the on-deck batter in the belief his swing or accuracy with one bat will be improved during his turn at bat. The batter generally swings several bats or other heavy object which simulates a heavy bat, in some cases a metal pipe. Although some heavy bats have been provided for this purpose, eg. bats with metal cylinders or balls enclosed therein, these have proved too complicated and expensive for wide acceptance. Further, the weight localization of these metal weights has given a pendulum effect rather than a bat-like feel to the practice bat. Moreover, the metal contents have knocked and chaffed against themselves and the bat interior. Accordingly, there is a need and market for a weighted bat that substantially overcomes the above objections.

There has now been developed a weighted practice or warm-up bat which is low cost, durable, and because of more even weight distribution, has a bat-like feel.

SUMMARY

Broadly, the present invention provides a practice ball bat comprising a handle and a tubular weight containing chamber mounted on said handle, weight means positioned in said chamber and means for closing said chamber.

DESCRIPTION

Figure 1:
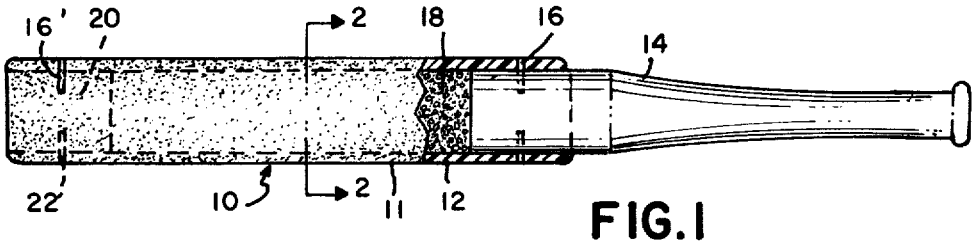
Figure 2:
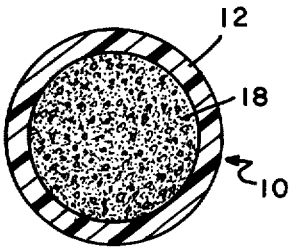

The invention will become more apparent from the following detailed descriptions and drawings in which:

FIG. 1 is a sectional elevation view of a practice bat embodying the present invention, and FIG. 2 is a cross-sectional view of the bat of FIG. 1 taken on line 2—2, looking in the direction of the arrows.

Referring now to the drawings, practice bat 10 has weight chamber 12, defined by walls 11 mounted to handle 14 thereof by dowels 16 as shown in FIG. 1. A granular material, eg. sand 18, occupies the chamber 12, being sealed therein by plug 20 fastened to the chamber walls 11 by dowels 22, as shown in FIG. 1. The sand 18 is also shown within bat 10 in FIG. 2.

The bat handle can be of various materials, eg. wood, plastic and the like, preferably wood.

The weight chamber is preferably of plastic, although wood and metal can be employed.

Preferably, the bat handle is of wood, the chamber is plastic, which renders the practice bat of the invention low cost and widely available to baseball players, including the Little League teams.

The size of the chamber is governed by the size and weight of the bat employed. The amount and weight of the material employed in the weight chamber is similarly governed.

If a lower weight is desired, the size of the plug can be increased and the amount of weighted material, eg. sand, can be reduced.

The distribution of the sand or other weighted material gives the weighted implement a bat-like feel rather than pendulum characteristics, which better prepares the batter for swinging an actual bat.

The chamber can be fastened to the handle, as above stated or can be integral therewith and be of different or the same material as the handle, eg. an all wood or all plastic bat.

The weight chamber is advantageously permanently sealed on both the handle and plug (outer) ends to simplify construction, lower the cost thereof, and to secure the bat components during a swing.

However, the plug and handle ends can screw onto the weight chamber if desired.

In a preferred embodiment, the handle screws into and seals the weight chamber. This arrangement serves a dual purpose; (1) the chamber can be opened to readily change the weight within the chamber, and (2) various sized (length and diameter) handles can be screwed onto the chamber to change the effective size of the bat of the invention. Locking means, eg. a tab or latch extending across the junction of the handle and chamber, can be provided to prevent the handle and chamber from unscrewing accidentally. Additionally, various sized chambers can fasten to said various sized handles to effect different size and weight combinations in the bat of the invention.

The weighted material is a flowable material, eg. granular pebbles, rounded or angular, flakes, powder, liquid, paste or a combination thereof.

The bat chamber can be fully or partially filled with weight material to change the weight of the bat. However, it is recommended the chamber be filled to prevent surgings or shifting of the weight while the bat is in use.

What is claimed is:

1. A practice bat comprising at least two main structural components, said components being an elongated handle section and a rigid tubular section having an elongated chamber therein; said tubular section being of larger external cross-sectional dimension than said handle section, said handle section having a hand engaging portion adjacent one end and a portion thereof at the other end telescoped into said tubular section in axial alignment therewith; means fastening said portion at the other end of said handle section in said tubular section; flowable particle weight means positioned in said chamber and spaced from each end of said tubular section to approximate the bat-like feel of an actual playing bat, said portion at the other end of said handle section closing one end of said chamber and means for closing the other end of said chamber.

2. The bat of claim 1 wherein said tubular section is a plastic cylinder.

3. The bat of claim 2 wherein said weight means is sand.

4. The bat of claim 1 having a series of different sized interchangeable handles which fasten and unfasten from said tubular section to permit access to said chamber and to allow change of effective size of said bat.

5. The bat of claim 4 having a series of different sized interchangeable tubular sections which fasten and unfasten to said handles.

6. The practice bat of claim 2 wherein the bat is a baseball bat.

7. The practice bat of claim 2 wherein the bat is a softball bat.

* * * * *